US005492321A

United States Patent [19]

Cipriano

[11] Patent Number: 5,492,321

[45] Date of Patent: Feb. 20, 1996

[54] BATTING PRACTICE DEVICE

[75] Inventor: Ronald J. Cipriano, Longwood, Fla.

[73] Assignee: Funtec, Inc., Longwood, Fla.

[21] Appl. No.: 262,388

[22] Filed: Jun. 20, 1994

Related U.S. Application Data

[63] Continuation of Ser. No. 34,482, Mar. 19, 1993, abandoned, which is a continuation-in-part of Ser. No. 844,557, Mar. 2, 1992, Pat. No. 5,230,506.

[51] Int. Cl.[6] ..... A63B 69/40

[52] U.S. Cl. ..... 273/26 R

[58] Field of Search ..... 273/80 R, 26 R, 273/29 A

[56] References Cited

U.S. PATENT DOCUMENTS

| | | | |
|---|---|---|---|
| 1,631,926 | 6/1927 | Dickinson, Jr. | 273/80 B |
| 1,715,586 | 6/1929 | Barkley | 273/80 B |
| 1,736,583 | 11/1929 | Delke | 273/207 |
| 1,967,355 | 7/1934 | Edwards | 273/80 D |
| 2,388,463 | 11/1945 | Benecke | 273/186.2 |
| 2,396,408 | 3/1946 | Benecke | 273/186.2 |
| 2,462,955 | 3/1949 | Glancey | 273/186.2 |
| 2,475,927 | 7/1949 | Verderber | 273/80 D |
| 2,765,170 | 10/1956 | Brown | 273/26 E |
| 2,832,598 | 4/1958 | Strub | 273/80 D |
| 3,428,325 | 2/1969 | Atkinson | 273/193 B |
| 3,461,593 | 8/1969 | Martuch | 273/80 B |
| 3,731,925 | 5/1973 | Caldwell | 273/26 E |
| 3,921,976 | 11/1975 | Lane | 273/26 R |
| 4,022,467 | 5/1977 | Reuss | 273/29 A |
| 4,042,237 | 8/1977 | Moraru | 273/29 A |
| 4,118,033 | 10/1978 | Miyamoto | 273/80 B |
| 4,249,729 | 2/1981 | Gabrielidis | 273/29 A |
| 4,486,472 | 7/1984 | Terza | 273/26 E |
| 4,513,965 | 4/1985 | Aschermann | 273/26 R |
| 4,555,111 | 11/1985 | Alverez | 273/29 A |
| 4,610,451 | 9/1986 | Keys | 273/207 |
| 4,932,661 | 6/1990 | Chio | 273/80 D |
| 5,004,236 | 4/1991 | Kameshima | 273/80 B |
| 5,026,063 | 6/1991 | Rhodes | 273/80 B |
| 5,026,064 | 6/1991 | Novosel | 273/186.5 |
| 5,230,506 | 7/1993 | Cipriano | 273/26 R |

FOREIGN PATENT DOCUMENTS

| | | | |
|---|---|---|---|
| 732978 | 4/1966 | Canada | 273/80 D |
| 772931 | 4/1957 | United Kingdom | 273/80 D |
| 1338255 | 11/1973 | United Kingdom | 273/80 D |
| 2231498 | 11/1990 | United Kingdom | 273/80 B |

*Primary Examiner*—Theatrice Brown
*Attorney, Agent, or Firm*—Michael K. Gray

[57] ABSTRACT

A practice device for enabling a batter to practice his batting skills as well as eye and hand coordination, comprising a relatively stiff, elongate tubular member with a handle located on one end, with the other end of the member being open and containing in its interior, an elongate, ball-supporting member. This ball-supporting member is slidably disposed in a telescopic manner in the interior of the tubular member, with a ball being tightly disposed on the outer end of the ball-supporting member. Advantageously, the ball-supporting member is readily movable between a compacted position in which most of its length is contained in the interior of the tubular member, and an extended position in which only a relatively small amount of the length of the ball-supporting member remains inside the tubular member. To assure the ball-supporting member remaining in the extended position during use, I utilize a locking collar, which can also be used to retain the ball-supporting member in the compacted position. I prevent the ball-supporting member taking on a permanent set as a result of extensive use by utilizing a relatively rigid member extending the length of the ball-supporting member, I also utilize an arrangement functional in the interests of safety for preventing the ball-supporting member from becoming separated during use.

5 Claims, 4 Drawing Sheets

BATTING PRACTICE DEVICE

RELATIONSHIP TO PREVIOUS INVENTION

This application is a continuation of prior application Ser. No. 08/034,482, filed on Mar. 19, 1993 (now abandoned), under the same title, which was a continuation-in-part of Ser. No. 07/844,557, which was filed Mar. 2, 1992 and was issued as U.S. Pat. No. 5,230,506 on Jul. 27, 1993 for "Batting Practice Device".

BACKGROUND OF THE INVENTION

1. Field of the Invention

The present invention relates to sporting equipment and more particularly to an improved batting practice device.

2. Description of the Prior Art

The prior art exhibits a number of training devices for improved batting performance. One example is that of batting-tee-type devices. The batting-tee devices exhibit a vertical support member upon which a ball is placed. A batter can then swing at the stationary ball on top of the support member thereby removing the need for a pitcher. Some designs have exhibited an elastic support member which is integral with a ball-shaped region at the top of the support member. One such device which teaches an integral support and ball-shaped region is disclosed in U.S. Pat. No. 4,846,472. Such an integral batting tee device removes the need for retrieving batted balls. However, one problem with batting tees is that they do not lend themselves to the practice of hitting a moving object. Furthermore, in that it is desirable to gain proficiency in hitting balls at various locations of the strike zone, time is wasted in adjusting the batting tee to a desired height and position.

An answer to the problems inherent in stationary batting tees has been addressed by the introduction of hand-held batting practice devices. These devices are typically characterized by exhibiting a gripping portion, a connecting portion, and an impact portion. In operation, the hand-held batting practice devices require a holder and a batter. One individual holds the gripping portion of the device and extends the device so that the impact portion of the device is in a desired location for the batter to practice his or her swing. By the holder moving and accelerating the device, a batter can practice hitting different types of pitches at various locations of the strike zone.

One hand-held batting practice device is disclosed in U.S. Pat. No. 2,765,170. The device has a helical spring which is connected to a gripping region located at one end of the helical spring, the other end of the helical spring being connected to a ball. However, one drawback of the device taught in U.S. Pat. No. 2,765,170 is that the device is held such that it descends, as opposed to extending laterally, from the holder's hands. In that the device disclosed in U.S. Pat. No. 2,765,140 descends from the holder's hand, the holder is placed in closer proximity to the batter which increases the probability of a holder being accidently struck by a bat.

Other hand-held batting practice devices are disclosed in U.S. Pat. Nos. 3,921,976, 4,513,965 and 4,846,472. These devices are intended to be held such that the ball or impact regions of the devices extend laterally away from the holder and toward the batter. However, one problem with these devices is that the holder's hand, elbow and shoulder can be subjected to significant stress and strain as a result of impact-produced torque.

U.S. Pat. No. 4,846,472 does seek to reduce the impact-produced shock experienced by a holder's hands. However, the device taught in U.S. Pat. No. 4,846,472 teaches a singular tubular extension which is connected at one end to a grip region. At the end opposite to the grip region is located an opening to the tubular extension and it is upon this opening that a ball is positioned in a rest position. The ball is secured to the device by means of an elastic cord or string. A screw connects the one end of the string to the grip at a location inside of the tubular extension. A second screw connects the other end of the string to the ball. In that a bat will most often impact both the ball and that part of the tubular extension proximate the ball, significant torque will still be experienced at the grip region. Furthermore, string and screw connections have a history and propensity of becoming disengaged when exposed to significant stresses over time.

Thus, a need exists for a simple, easily used and durable hand-held batting practice device which will tend to minimize the reaction forces imparted to the holder of the device, and such a device is set forth herein.

SUMMARY OF THE INVENTION

A practice device in accordance with this invention for enabling a batter to practice his batting skills as well as eye and hand coordination comprises a relatively stiff, elongate tubular member having first and second ends, with a handle located on the first end, and the second end being open. An elongate, flexible, ball-supporting member is utilized in telescopic relation with the tubular member, with a ball being tightly secured on one end of the ball-supporting member. The other end of the ball-supporting member is slidably disposed in the interior of the relatively stiff tubular member, with the ball-supporting member being readily movable between a compacted position in which most of its length is contained in the interior of the tubular member, and an extended position in which only a relatively small amount of the length of the ball-supporting member remains inside the tubular member. The ball is preferably made of urethane foam, foam rubber or similar material which will absorb a degree of the impact shock.

I advantageously utilize a locking means on the end of the tubular shaped, relatively rigid member, which locking means preferably takes the form of a rotatable collar. This arrangement enables the user to secure the flexible member, on occasion, in the extended position, such that the ball will be appropriately positioned for being struck by an implement swung by a batter. When not in use, the resilient, flexible ball-supporting member can be compacted for storage by returning it to the interior of the tubular shaped, relatively rigid member.

In the interests of safety, I anchor a nylon cord or the like in the interior of the relatively stiff outer member, which cord is attached to the end of the flexible member disposed in a telescopic relation with the outer member. The nylon cord is of a carefully selected length, such that it prevents the flexible member from entirely coming out of the outer member.

To prevent the resilient, flexible ball-supporting member from taking a permanent bend or being crushed, I utilize on its interior an elongate member having a controlled amount of flexibility.

Accordingly, a first object of the present invention is to provide a durable, lightweight batting practice device for helping a batter improve his hand/eye coordination.

Another object of the present invention is to provide a hand-held batting practice device which is constructed to minimize the occurrence of injury to the holder of the device, and which is extensible from a compacted condition to enable a ball utilized on the end of the device to be placed at a considerable distance from the holder, for the holder's safety.

Still another object of the present invention is to provide a highly effective, durable, easily affordable batting practice device which is of simple construction, and which can be readily compacted for the purposes of shipping or storage.

Yet another object of my invention is to provide a batting practice device that is safe to use, and which effectively resists deformation that would impair its ability to be compacted.

It is yet still another object of the present invention to provide a flexible, resilient member operatively disposed in a relatively rigid tubular member, with the arrangement being such that the tubular member, the flexible member and the connecting means comprise a torque reduction means for reducing the torque experienced by an individual holding the handle of my device when the target is struck by an implement or striking member swung by a second individual.

These and other objects, features and advantages will be more apparent from a study of the appended drawings.

BRIEF DESCRIPTION OF DRAWINGS

A more complete appreciation of the invention and many of the attendant advantages thereof will be readily obtained by reference to the following detailed description when considered in connection with the accompanying drawings, wherein.

When referring to the drawings, it should be understood that like reference numerals designate identical or corresponding parts throughout the respective figures.

DETAILED DESCRIPTION OF THE INVENTION

Figure 1:
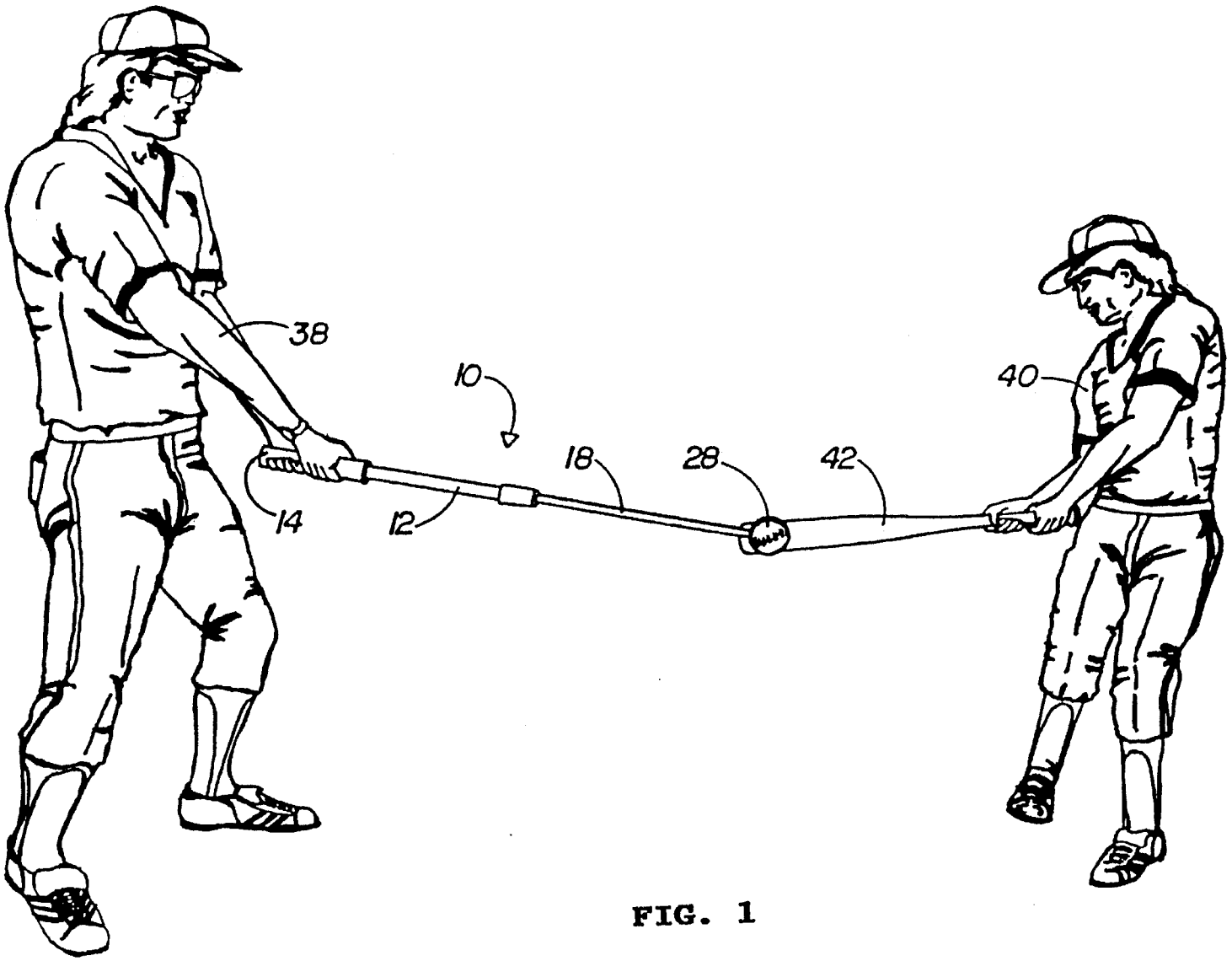
FIG. 1 is an illustration of a typical use of my device, wherein one person holds the target member, and the other person swings a bat at the target member.
Figures 2, 3:
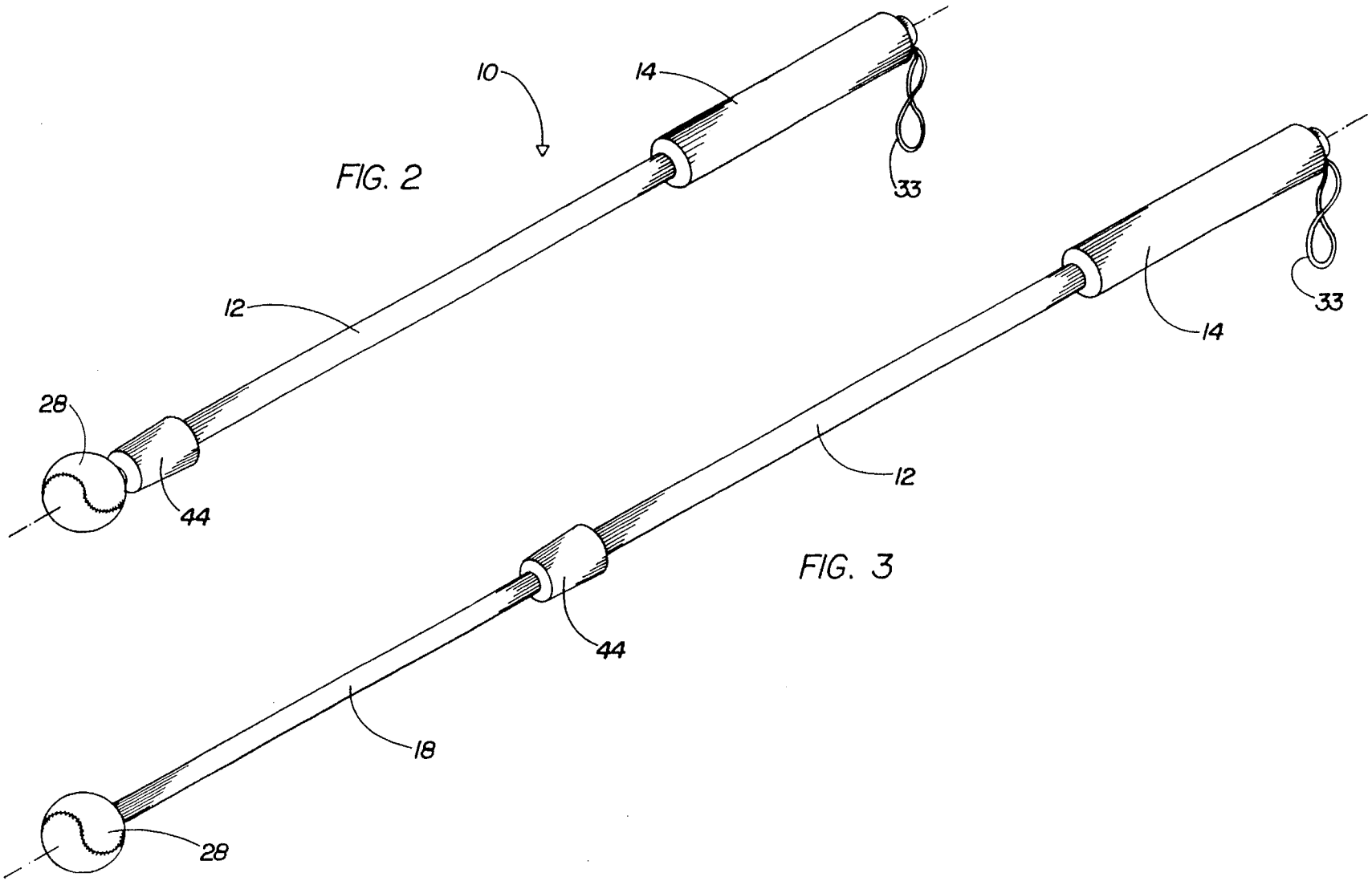
FIG. 2 is a schematic illustration of a typical device in accordance with the present invention, revealing a condition in which the flexible, ball-supporting member has been moved into its compacted position inside the relatively stiff outer member.
FIG. 3 is a schematic illustration revealing the flexible, resilient ball-supporting member of FIG. 2 when it has been moved outward into its extended position.

With initial reference to FIG. 1, it will be seen from this figure that I have shown a batting practice device 10 in accordance with this invention, involving a tubular shaft 12 of generally rigid material, upon the end of which is utilized a handle 14. Contained inside the shaft 12 is a flexible member 18, upon the outer end of which is a target member 28, typically in the configuration of a baseball, although I am not to be limited to this. The tubular shaft 12, which may hereinafter be referred to as the first member, the handle 14 and the target member 28 are shown in greater detail in FIG. 2. The relationship of these members to the extensible member 18 is shown in FIG. 3, and I may hereinafter refer to the flexible member 18 as the second member.

In FIG. 1 it is to be seen that the batting practice device 10 is being held by a person 38, with the device 10 being held in approximately a horizontal attitude for the convenience of the batter 40. As visible in this figure, the batter 40 is holding a bat 42, which he swings with the intent of striking the target 28, which is spherical in shape, and in the preferred instance, closely resembles a baseball. The target member 28 is typically made of urethane foam, foam rubber or similar material.

It is to be understood that the flexible second member 18 forms the support for the ball-shaped member 28, which is firmly affixed to the free end thereof. As will be obvious, the person 38 assisting the batter can hold the device 10 by the handle 14, and support the ball-shaped member 28 in a position for being swung at with an implement held by the batter 40. In the instance depicted in FIG. 1, the implement being swung by the person 40 is a baseball bat 42, although the implement utilized in other sports could be used as well in conjunction with this invention.

As should be quite apparent, the holder 38 can move and swing the device 10 in such a manner that batter 40 can effectively practice hitting various types of pitches at various speeds and locations in the strike zone. As an option, I can utilize a cord 33 at the end of handle member 14, as shown in FIGS. 2 and 3, to be secured around the wrist of the holder 38 to the device 10. Such a cord can also be used as a means to hang the device 10 up on a rack or hanger when the device is not in use or is in storage.

It is to be understood that the device 10 of the present invention eliminates the need to chase balls and pitch balls, and increases the amount of time to practice and concentrate on improving batting technique. The device is ideal for younger players such as little leaguers in that a player can be instantly corrected as to how to better hit a pitch and thereby improve stance, swing, and hand/eye coordination. Because the device 10 is in accordance with this invention extensible, the ball or target 28 can be disposed at a safe distance from the holder 38, to prevent him from being struck by the bat 42 during batting practice.

With reference now to related FIGS. 2 and 3, it will be seen now in further detail that the present novel batting practice device 10 is largely constituted by the relatively rigid first member 12 and the flexible second member 18. A handle 14 may be secured to the end of the member 12. Although I am not to be limited to any particular material, I prefer the use of PVC material in the construction of the member 12, because of its rigidity, lightness, durability and inexpensiveness. In FIG. 2 the device 10 is shown in its compacted position, in which the flexible member is entirely contained within the rigid member 12, which of course is the position suitable for shipping as well as storage.

From FIG. 3 it can be readily seen that the device 10 is of an extensible nature, with the flexible, resilient second member 18 being of a length such that it can be entirely contained within the relatively rigid, tubular-shaped first member 12. By appropriate means, the target member or ball 28 is tightly secured at the outer end of the flexible member 18. As should now be entirely clear, when the member 18 is in the extended position shown in FIGS. 1 and 3, the target member or ball 28 is readily employable for helping a batter improve his hand and eye coordination. Because of the relatively great length of the extended device, it can be safely held for the convenience of the batter, without jeopardizing the safety of the person holding the device 10.

In the prototype of the present invention, shaft 12 was twenty-seven inches long, but obviously I am not to be limited to this dimension.

With continuing reference to FIGS. 2 and 3, it is to be understood that the handle 14 is preferably of one-piece construction, being for example molded foam rubber or other easily grippable and shock absorbing material. The handle 14 is preferably inserted over the holding end of the elongate tubular member or shaft 12, and secured in place by the use of a suitable glue or cement. I may optionally provide a plug on the outer end of the handle, utilized for a purpose to be described at greater length hereinafter.

In the prototype of the present invention the handle 14 was approximately 4¾ inches long, but obviously I am not to be limited to this dimension. As previously mentioned, I may utilize an exterior cord attached to the handle 14.

The flexible member 18, also referred to as the second member, is operatively associated with tubular shaft 12, with the free end of the member 18 being easily accommodated in the interior of the first member 12, as is apparent from the several figures. The flexible member 18, which may also be referred to as the ball-supporting member, has an external diameter which is less than the internal diameter of the hollow region of shaft 12, in order that it may be readily accommodated within the interior of shaft 12.

The member 18 is resilient, meaning that it will return to its original straight condition after bending as a result of being struck. This member is preferably made of flexible plastic tubing or a material having similar physical properties. For reasons of structural integrity, a portion of the flexible member 18 remains inside shaft 12 when the flexible member has been moved to the extended position, and in this region I prefer to utilize a suitable plug or elongate spacer, such as of vinyl or wood, that is approximately five inches long. This detail will be discussed at greater length hereinafter.

Figure 5:
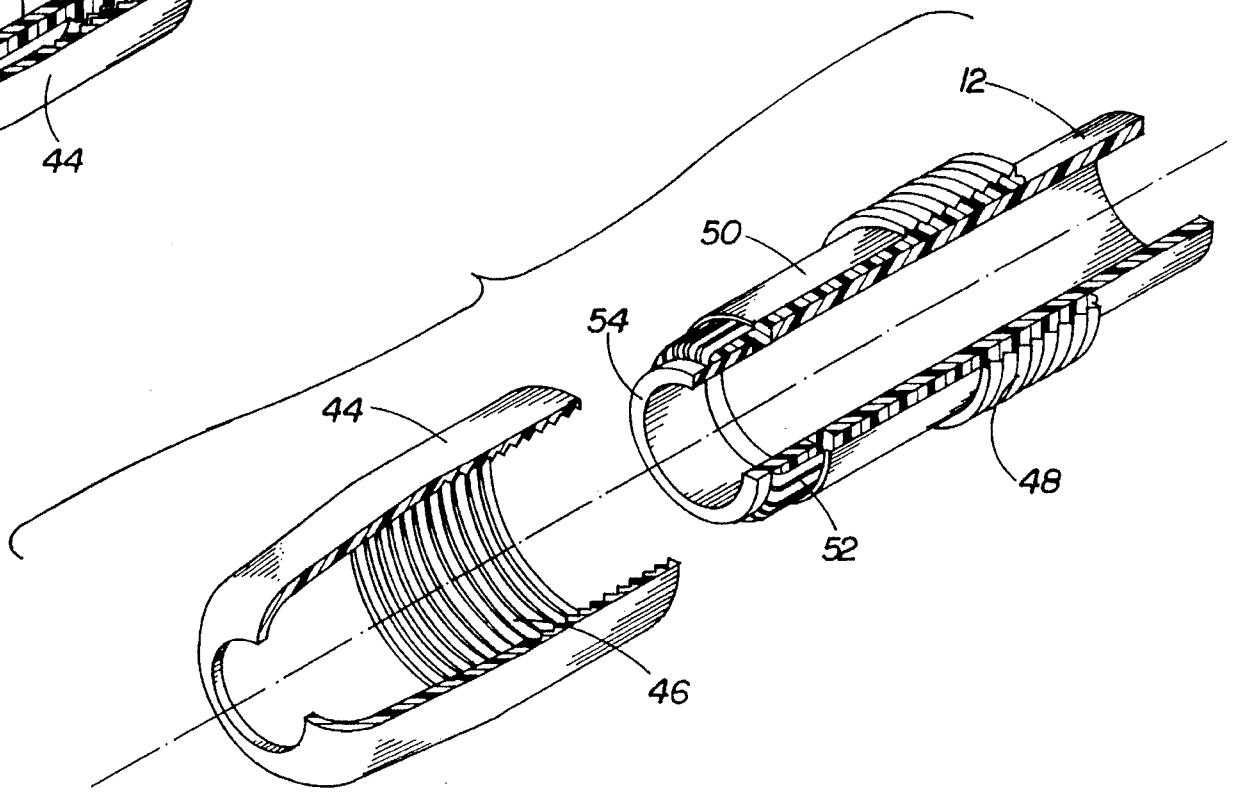
FIG. 5 is a view resembling FIG. 4 but showing the collar having been removed from the collet.
Figure 4:
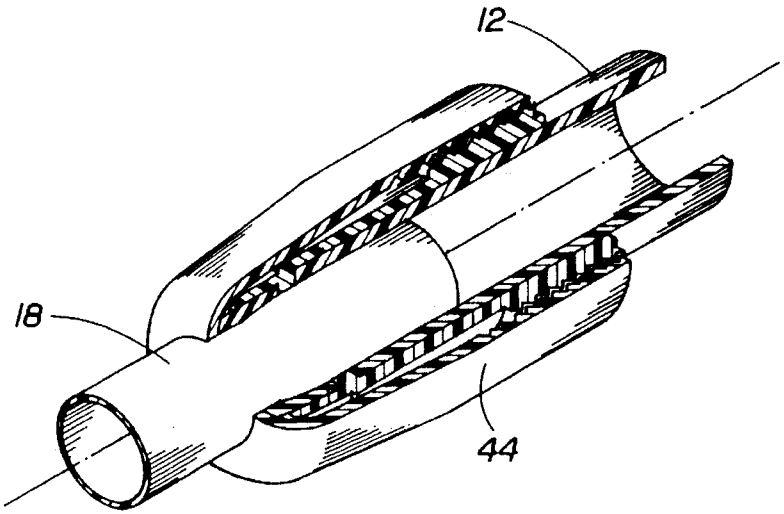
FIG. 4 is a fragmentary view, revealing my novel collar member in the tightened condition.

As visible in FIGS. 4 and 5, I prefer to use a locking means in the form of a rotatable collar 44, which is internally threaded, with FIG. 5 revealing internal threads 46, which are intended to threadedly engage the threads 48 forming a part of collect 50 that is firmly attached to the end of the shaft 12. Although any of a number of different threads could be used, I prefer to use an Acme thread, with approximately five threads per inch. In this way, after the collar 44 has been tightened, it may be loosened either by a lady or a child, for the coarse thread I prefer to use is relatively easy to loosen.

To permit the collar 44 to effectively tighten the end of the collet 50 around the flexible member 18, I prefer to utilize a plurality of slots 52 in the nature of saw cuts at spaced locations around the periphery of the end of the collet, with the curved interior of the upper end of the collar 44 serving to cause the portions of the collet between the slots 52 to move into a very tight relationship with the sidewall of the flexible member 18. To provide additional gripping power, I prefer to utilize a rubber grommet 54 between the shaft of member 18, and the slotted end of the collet 50. In this way, when the collar 44 has been sufficiently rotated in the tightening direction, the grommet 54 is caused to grip the member 18 very tightly.

As by now should be obvious, the versatility of this arrangement is such that the collar 44 can be tightened so as to lock the flexible member 18 in the fully extended position, a partially extended position, or the compacted position, whichever is appropriate in a given instance.

The collar 44 is shown in the removed position in FIG. 5 only for reasons of clarity, for in normal use, it is only necessary to loosen the collar in order to be able to move the flexible member 18 into or out of the shaft 12. As is entirely obvious, after the member 18 has been moved to the desired position, it is then necessary to tighten the collar, to prevent the flexible member from moving away from that position.

I have found with extensive use, an ordinary flexible member 18 tended to take on a degree of permanent set, adversely affecting its appearance and utility, and in some instances impairing its ability to be received in the hollow shaft 12. Therefore, in accordance with a preferred embodiment of this invention, I utilize suitable internal means for minimizing deflection and assuring resilience, or in other words, preventing the member 18 from tending to take on, or to remain in, a bent condition.

Figures 6, 6A:
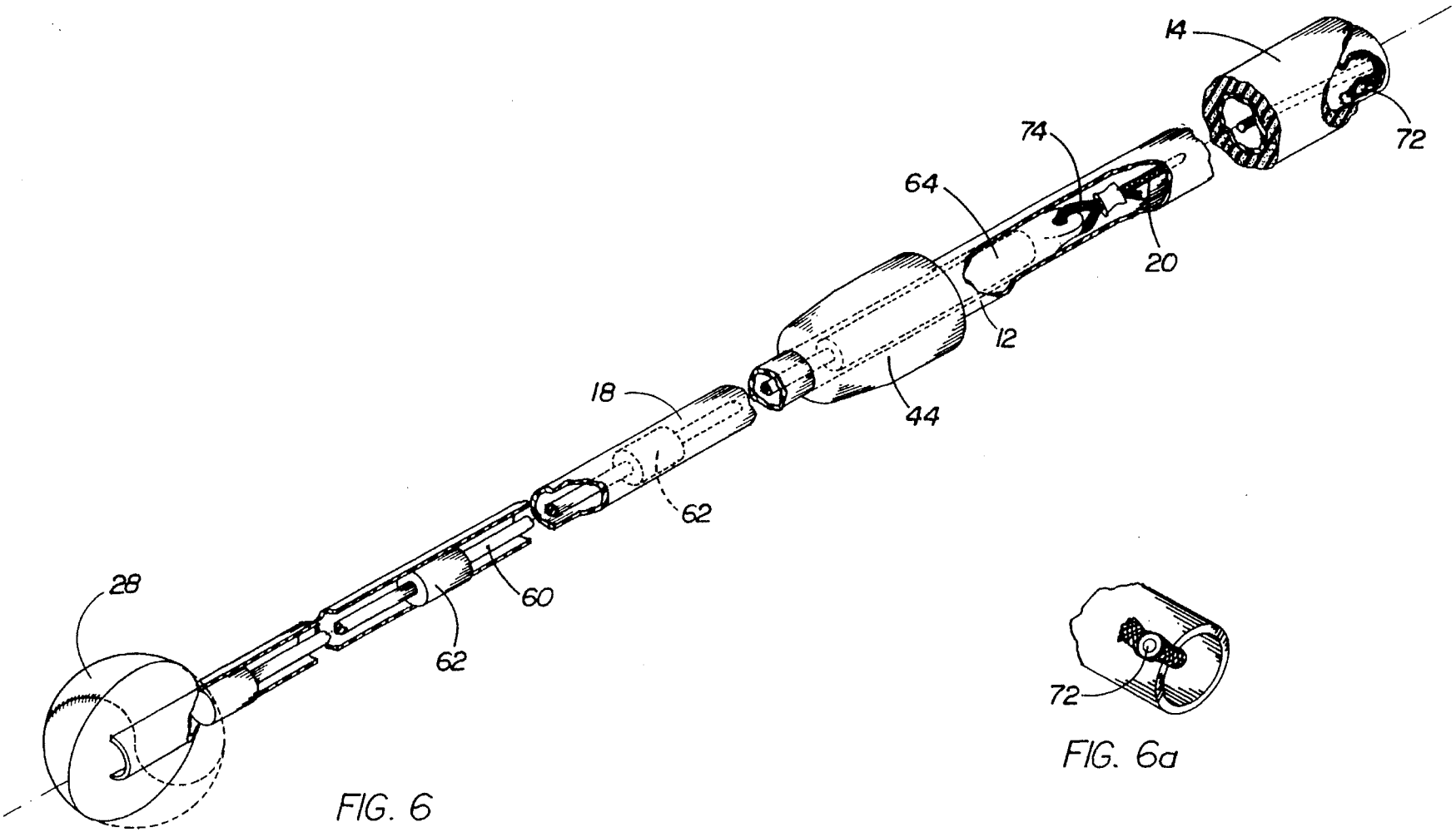
FIG. 6 is a view, partly in section and illustrating a preferred form of a device utilized to assure that the flexible ball-supporting member has resilience, and for preventing it from taking on a permanent bend, with this figure also revealing a stout cord utilized as a safety means inside the relatively rigid tubular member, for preventing the flexible member from becoming separated from the tubular member to which the handle is attached.
FIG. 6*a* is a fragmentary view of a preferred way of affixing the end of the stout cord utilized as a safety measure, to a location inside the handle end of the relatively stiff outer member, in this instance a rivet being utilized for this purpose.

In the preferred embodiment of this invention depicted in FIG. 6, I reveal that the sidewall of the member 18 is relatively thin, with a relatively stiff, resilient rod 60 extending down the central interior portion of the member 18. The rod 60 can, for example, be of acetal delrin and be 0.312 inches in diameter, which of course is considerably smaller than the dimension of the interior of the member 18. The interior dimension of the member 18 is typically on the order of ½ inches. The resilient rod 60 could also be made of steel.

In order for the relative rigidity of the rod 60 to be passed along to the member 18, I utilize a number of spacer members 62, such as of vinyl, although I am not to be limited to this material. The spacer members 62 should have an outer diameter relatively closely approximating the interior dimension of the member 18, and be disposed at intervals of approximately six inches along the rod 60, although I am not to be limited to this.

With reference to FIG. 6, it is to be seen that I utilize a comparatively long plug or spacer 64 at a location adjacent the inner end of the member 18. The reason for the long spacer 64 at this location is =two-fold, with one being to provide a firm surface against which the collar 44 may be tightened. An additional reason is to prevent bending of the member 18 at the location where the member 18 emerges from the collar 44. Without the long spacer 64 in the interior of the member 18 at this location, there is a tendency for the member 18 to take on a permanent deformation, which is of course to be avoided.

It is to be understood that a batter may strike the ball 28 with a considerable amount of force, thus requiring the ball to be firmly attached to the end of the flexible member 18 if dislodgment is to be prevented. I may prefer to drill holes in the end of the member 18, so that at the time of manufacture, when the end of the member 18 is glued or cemented inside the interior of the ball 28, there will be a considerable amount of contact surface and holding power.

In the preferred instance, I mold the ball 28 in place at the end of the flexible member 18 by the use of a water blown urethane foam, in conjunction with which a two-part mold (not shown) is utilized. Each half of the internal portion of the mold is configured to resemble a baseball, so that when the end of the member 18 is inserted into the mold, and the urethane material is poured into the mold, the result is a baseball-shaped component tightly molded to the end of the flexible member. As is obvious, the material out of which the ball 28 is molded tends to enter the several holes that were formed in the end of the member 18, causing the ball 28 to grip the end of the member 18 very tightly.

In order to provide a tough covering or hide around the ball so formed, I typically spray a flexible vinyl coating onto both interior surfaces of the mold halves before the urethane is poured. In this way, when the mold halves are opened approximately one minute after the urethane is poured, it will be seen that a baseball-shaped component has been molded in a highly satisfactory manner to the end of the flexible shaft member 18.

Another consequence of the batter striking the ball 28 with great ferocity is the possibility of the flexible member 18 coming entirely out of the shaft portion 12, despite the collar member 44 having been securely tightened. To this end, I utilize a strong nylon cord 70 of limited length on the inside of the member 12, with one end of this cord being attached to the end of the handle 14, such as by a rivet 72 fastened to the end of the member 12, as shown in FIGS. 6 and **6*a*. As an alternative, the one end of the cord 70 could be affixed to the handle end of the device by means of a plug driven into the end of member 12. A loop 74 is formed on the other end of the cord 70, to permit it to be readily attached to the end of the flexible member 18, thus to form a positive means for preventing member 18 from entirely separating from the rigid member 12**.

The sturdy nylon cord 70 is of a carefully chosen length, and is loosely contained in the end of the member 12 when the device is in the compacted condition. However, it is to be clearly understood that at such time as the user pulls out the inner member 18 to its functional length, the nylon core 70 effectively prevents the member 18 from entirely coming out of the member 12.

Because the member 18 is of resilient, flexible material, this represents a torque reducing means in that most of the load resulting from the target or ball 28 being impacted by the implement 42 is absorbed, and not transmitted to the handle 14 located at the holding end of the tubular member 12. Further, the target 28 being made of urethane foam, rubber or other shock absorbing material, the initial shock experienced by the device 10 is considerably reduced. As previously mentioned, the handle 14 is made of a shock absorbing material (e.g. rubber) to reduce the amount of vibration experienced by an individual holding the device 10 when the target 28 is impacted by a striking object, such as the implement 42.

Inasmuch as my device is readily movable from a compacted position into an extended position, it provides a maximum amount of safety to the holder of the device, in that the holder of the device may be far removed from the arc through which the batter 40 swings the implement 42.

As should now be readily apparent, my novel device is designed to minimize the amount of shock and torque experienced by a holder when the target 28 of the device 10 is impacted by a bat 42 or other striking object.

The foregoing detailed description is intended to be illustrative and non-limiting. Many changes and modifications are possible in light of the above teachings. Thus, it is understood that the invention may be practiced otherwise than as specifically described herein and still be within the scope of the appended claims.

I claim:

1. A sport practice device for developing ball hitting skills, comprising:

an elongated shaft having a target end and a holding end, said holding end to be held be a first individual such that said target end is pointed toward a second individual having a striking instrument for making contact with a target connected to said target end, said elongated shaft having means for reducing the torque experienced by the first individual when said target is impacted by a striking instrument held by the second individual, said holding end being a substantially rigid tubular shaft section, said tubular shaft section having a connecting end opposite said holding end;

said torque reducing means being a flexible shaft section, said flexible shaft section having a diameter less than that of said tubular shaft section, said flexible shaft section having a target attached to a first end and a second end inserted into said rigid tubular shaft section at said connecting end of said rigid tubular shaft section so as to be slidably engaged therein to allow the target to be extended away from said connecting end;

a collar locking means for securing said flexible shaft section to said rigid tubular shaft when said flexible shaft section is in an extended position;

a collet connected to said connecting end of said rigid tubular shaft;

a collar threadably engaged with said collet;

a cord connected to the interior of said rigid tubular shaft section and connected to said flexible shaft section to prevent said flexible shaft section from being dislocated from said rigid tubular shaft section when said target is impacted by said bat; and wherein the striking instrument is a bat.

2. A practice device according to claim 1, wherein said flexible shaft section is resilient and tubular.

3. A practice device according to claim 2, further comprising:

a resilient rod extending down the central interior of said flexible shaft section, said resilient rod having a plurality of spacer members connected to said resilient rod and to the interior of said flexible shaft section.

4. A practice device according to claim 3, wherein said resilient rod is further provided with a long plug for engaging the interior of said flexible shaft section against which said collar may me tightened.

5. A practice device according to claim 1, wherein said target has the shape of a conventional baseball and is made of a shock absorbing material.

* * * * *